US010006135B2

(12) United States Patent
Schulz et al.

(10) Patent No.: US 10,006,135 B2
(45) Date of Patent: Jun. 26, 2018

(54) ELECTROPLATING BATH AND METHOD FOR PRODUCING DARK CHROMIUM LAYERS

(71) Applicant: Atotech Deutschland GmbH, Berlin (DE)

(72) Inventors: Klaus-Dieter Schulz, Falkensee (DE); Philipp Wachter, Berlin (DE); Philip Hartmann, Berlin (DE)

(73) Assignee: Atotech Deutschland LLP, Berlin, DE (US)

( * ) Notice: Subject to any disclaimer, the term of this patent is extended or adjusted under 35 U.S.C. 154(b) by 0 days. days.

(21) Appl. No.: 15/483,122

(22) Filed: Apr. 10, 2017

(65) Prior Publication Data

US 2017/0211197 A1 Jul. 27, 2017

Related U.S. Application Data

(62) Division of application No. 14/113,247, filed as application No. PCT/EP2012/057830 on Apr. 27, 2012, now Pat. No. 9,689,081.

(30) Foreign Application Priority Data

May 3, 2011 (EP) ..... 11164641

(51) Int. Cl.

| | |
|---|---|
| ***C25D 3/56*** | (2006.01) |
| ***C25D 3/04*** | (2006.01) |
| ***C25D 3/06*** | (2006.01) |
| ***C25D 3/10*** | (2006.01) |
| ***C25D 3/08*** | (2006.01) |

(52) U.S. Cl.
CPC ..... *C25D 3/10* (2013.01); *C25D 3/06* (2013.01); *C25D 3/08* (2013.01)

(58) Field of Classification Search
CPC ..... C25D 3/06; C25D 3/08; C25D 3/10
USPC ..... 205/243, 285, 287, 288, 289, 290
See application file for complete search history.

(56) References Cited

U.S. PATENT DOCUMENTS

| | | | | |
|---|---|---|---|---|
| 4,054,494 | A * | 10/1977 | Gyllenspetz | C25D 3/06 205/243 |
| 4,196,063 | A | 4/1980 | Barnes et al. | |
| 4,450,052 | A | 5/1984 | McMullen et al. | |
| 4,473,448 | A | 9/1984 | Deeman | |
| 2007/0227895 | A1 | 10/2007 | Bishop et al. | |
| 2009/0114544 | A1* | 5/2009 | Rousseau | C25D 3/06 205/243 |
| 2010/0243463 | A1* | 9/2010 | Herdman | C25D 3/06 205/180 |

FOREIGN PATENT DOCUMENTS

| | | |
|---|---|---|
| GB | 1596995 | 9/1981 |
| JP | 2009035806 | 2/2009 |

OTHER PUBLICATIONS

PCT/EP2012/057830; PCT International Search Report and Written Opinion of the International Searching Authority dated Jun. 6, 2013.
Co-pending U.S. Appl. No. 14/113,247, filed Oct. 22, 2013.
Co-pending U.S. Appl. No. 14/945,027, filed Nov. 18, 2015.

* cited by examiner

*Primary Examiner* — Edna Wong
(74) *Attorney, Agent, or Firm* — Renner, Otto, Boisselle & Sklar, LLP

(57) ABSTRACT

The invention relates to electroplating baths and methods for electrodepositing a dark chromium layer on a workpiece. The trivalent chromium electroplating baths comprise sulphur compounds and the methods for electrodepositing a dark chromium layer employ these trivalent chromium electroplating baths. The dark chromium deposits and workpieces carrying dark chromium deposits are suited for application for decorative purposes.

16 Claims, No Drawings

ELECTROPLATING BATH AND METHOD FOR PRODUCING DARK CHROMIUM LAYERS

CROSS-REFERENCE TO RELATED APPLICATIONS

The present application is a division of and claims priority under 35 U.S.C. § 120 to co-pending, commonly assigned U.S. application Ser. No. 14/113,247, filed 22 Oct. 2013, now U.S. Pat. No. 9,689,081 B2, which is in turn a U.S. National Stage Application based on and claiming benefit and priority under 35 U.S.C. § 371 of International Application No. PCT/EP2012/057830, filed 27 Apr. 2012, which in turn claims benefit of and priority to European Application No. 11164641.0, filed 3 May 2011, the entirety of each of which is hereby incorporated herein by reference.

FIELD OF THE INVENTION

This invention relates to methods and plating baths for electrodepositing a dark chromium layer. More particularly, the invention relates to methods employing trivalent chromium electroplating baths containing sulphur compounds. Further the invention relates to dark chromium deposits and workpieces carrying dark chromium deposits as well as their application for decorative purposes.

BACKGROUND OF THE INVENTION

Interest in dark chromium deposits has started already with developing chromium deposits from hexavalent chromium due to its high wear and corrosion resistance and high thermal and electrical conductivity. Dark chromium coatings have been used for decorative purposes and as solar radiation absorbing coating for solar collector panels.

Then chromium deposits originating from trivalent chromium came into focus because of its better environmental tolerance. Interestingly, the first commercially applicable trivalent chromium electroplating baths turned out to produce chromium coatings which were already of slightly darker colour than the coatings resulting from hexavalent chromium electroplating baths.

But the color of coatings obtained from trivalent chromium was not dark enough to meet the expectations for decorative parts or satisfy the requirements for solar collectors. A few strategies were developed to produce dark chromium coatings from trivalent chromium which are mainly in the field of solar collectors.

U.S. Pat. No. 4,196,063 to Barnes and Ward relates to trivalent chromium plating baths containing cobalt ions or iron II ions and phosphate ions, alternatively iron III and hypophosphite, which produce black chromium deposits with better electrical and thermal conductivity, better wear resistance and better toughness than black deposits from hexavalent chromium baths.

Selvam et al. (Metal Finishing, 1982, 107-112) performed a systematic investigation on compositions of trivalent chromium baths and conditions of electroplating black chromium coatings from these baths for application in solar thermal devices. Black deposits with properties similar to black deposits resulting from hexavalent chromium plating baths were obtained for bath compositions containing chromium chloride, ammonium chloride and oxalic acid. In addition the authors mention disadvantages of the composition and plating method like formation of chlorine, high consumption of oxalic acid, critical pH control, and nonadherent black deposits.

Abbott et al. (Trans Inst Met Fin, 2004, 82(1-2), 14-17) report on the possibility to produce a black chromium coating by electrodepositing it from an ionic liquid made of trivalent chromium chloride and choline chloride additionally containing lithium chloride. The black chromium deposits are especially thick, adherent and crackfree and are assumed to have a nanocrystalline structure.

Abdel Hamid (Surface & Coatings Technology 203, 2009, 3442-3449) presents a black chromium deposit on steel which was plated from a solution containing trivalent chromium ions, cobalt ions and hexafluorosilicic acid ($H_2SiF_6$) as an oxidizing agent. The resulting layers mainly consisted of chromium, chromium oxide and cobalt oxide. They revealed good absorbance properties for solar energy and good thermal stability and were therefore regarded as suitable for solar thermal applications.

The dark chromium deposits of the above mentioned state of the art present good properties for solar thermal applications. But these dark chromium deposits are not suited for decorative purposes because they are dull, even when deposited on bright surfaces. Actually, for decorative chromium deposits there is a demand for glossy dark chromium coatings.

Further several trivalent chromium electroplating baths containing sulphur compounds are reported.

Patent GB 1431639 to Barclay and Morgan relates to a chromium electroplating solution in which the source of chromium comprises a trivalent chromium-thiocyanate complex. The chromium-thiocyanate complex leads to formation of a bright, relatively hard, uncracked chromium layer with good corrosion resistance and the plating process had a better throwing power and current efficiency than in conventional chromic acid baths.

U.S. Pat. No. 4,473,448 to Deeman refers to electrodeposition of chromium from electrolytes containing trivalent chromium ions and low concentrations of thiocyanate or a spectrum of other sulphur containing compounds. Electroplating a workpiece with these electrolytes gave light colored chromium electrodeposits.

U.S. Pat. No. 4,448,648 to Barclay et al. discloses an electroplating solution for plating chromium from trivalent state. The electroplating solution additionally contains sulphur containing species having a S—S or S—O bond which promote chromium deposition. As a result a lower chromium concentration is needed within the electrolyte.

US Patent application 2010/0243463 relates to an electrolyte and method for decorative chromium coating. The electrolyte also contains sulphur-containing organic compounds. Employing this electrolyte yields chromium-sulfur alloy deposits that are more corrosion resistant especially in environments containing calcium chloride.

US Patent applications US 2009/0114544 A1 and US 2007/0227895 A1 by Rousseau and Bishop disclose a process and an electrodeposition bath for depositing nanogranular crystalline functional chromium deposits. The electrodeposition bath includes trivalent chromium, a source of divalent sulphur, and optionally ferrous ions. Attempts of the present inventors to produce decorative chromium deposits from the described electrolyte T7 containing thiosalicylic acid and ferrous sulphate were not successful. Actually no deposits could be generated when employing pH values of 2.8 and 4.2 within the electrolyte at current densities of 10, 20, 30 and 40 $A/dm^2$.

OBJECTIVE OF THE INVENTION

The electrodepositing baths and methods of the state of the art for depositing black chromium layers display a number of disadvantages like producing dull surfaces, employing environmentally critical cobalt, nickel, fluoride or phosphate ions, and further disadvantages mentioned above. The plating baths and methods for electrodepositing chromium from trivalent state for decorative purposes were mainly aimed to obtain chromium layers as light as the layers resulting from hexavalent chromium baths. Thus, there is a still unmet demand for trivalent chromium baths and methods for depositing glossy dark chromium layers on workpieces for decorative purposes.

Therefore it is an objective of the present invention to provide an electroplating bath and a method for depositing glossy, dark chromium layers for decorative purposes which counteract the disadvantages of the state of the art. It is another objective to provide an electroplating bath and a method for depositing dark chromium layers from trivalent chromium that are of darker color than the decorative chromium deposits reported by the state of the art. Further it is an objective to provide an electroplating bath and a method for depositing dark chromium layers from trivalent chromium that are glossier than the black chromium deposits for solar thermal applications. Moreover it is an objective to provide an electroplating bath and a method for depositing dark chromium layers from trivalent chromium without employing and co-depositing environmentally critical components like cobalt, nickel, fluoride or phosphate ions. Furthermore it is an objective to provide an electroplating bath and a method for depositing dark chromium layers from trivalent chromium that are of a uniform dark color.

SUMMARY OF THE INVENTION

These objectives are solved by an electroplating bath and a method for depositing a dark chromium layer on a workpiece by applying said electroplating bath, said electroplating bath comprising:

(A) trivalent chromium ions;
(B) carboxylate ions;
(C) at least one pH buffer substance; and
(D) at least one coloring agent selected from sulphur containing compounds having the general Formula (I)

Formula (I)

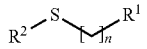

wherein n, $R^1$ and $R^2$ have the meanings as defined below, or having the general Formula (II)

Formula (II)

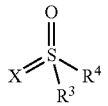

wherein =X, $R^3$ and $R^4$ have the meanings as defined below, or salts, tautomeric forms, betaine structures thereof; or a mixture of compounds of Formula (I) or salts, tautomeric forms, betaine structures thereof; or a mixture of compounds of Formula (II) or salts, tautomeric forms, betaine structures thereof; and a mixture of compounds of Formulae (I) and (II) or salts, tautomeric forms, betaine structures thereof.

The addition of a coloring agent selected from sulphur containing compounds according to Formula (I) or Formula (II) to the above mentioned electroplating bath results in chromium deposits of very attractive dark color. The addition of more than one coloring agent further deepens the dark color or changes the hue of the dark color.

DETAILED DESCRIPTION OF THE INVENTION

The present invention relates to an electroplating bath for depositing a dark chromium layer on a workpiece and a method for applying said electroplating bath.

The electroplating bath for deposition of a dark chromium layer on a workpiece comprises:

(A) trivalent chromium ions;
(B) carboxylate ions;
(C) at least one pH buffer substance; and
(D) at least one coloring agent selected from sulphur containing compounds having the general Formula (I)

Formula (I)

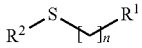

wherein n, p, q are independently of each other integers from 0 to 4;

$R^1$ represents —H, —OH, —COOH, —CO—$OCH_3$, —CO—$OCH_2$—$CH_3$, —(—O—$CH_2$—$CH_2$—)$_m$—OH, —CH(—$NH_2$)—COOH, —CH(—NH—$CH_3$)—COOH, —CH(—N(—$CH_3$)$_2$)—COOH, —CH(—$NH_2$)—CO—$OCH_3$, —CH(—$NH_2$)—CO—$OCH_2$—$CH_3$, —CH(—$NH_2$)—$CH_2$—OH, —CH(—NH—$CH_3$)—$CH_2$—OH, —CH(—N(—$CH_3$)$_2$)—$CH_2$—OH, —$SO_3$H;

m represents an integer from 5 to 15;

$R^2$ represents —H, —OH, —($CH_2$—)$_p$—OH, —($CH_2$—)$_p$—C(—$NH_2$)=NH, —$CH_2$—$CH_2$—(—O—$CH_2$—$CH_2$—)$_m$—OH, —$R^5$, —($CH_2$—)$_q$—COOH, —($CH_2$—)$_q$—CO—$OCH_3$, —($CH_2$—)$_q$—CO—$OCH_2$—$CH_3$, —($CH_2$—)$_q$—S—($CH_2$—)$_2$—OH, —CS—$CH_3$, —CS—$CH_2$—$CH_3$, —CS—$CH_2$—$CH_2$—$CH_3$, —CN,

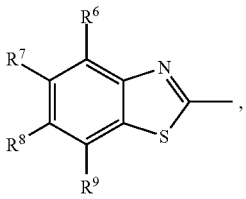

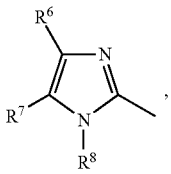

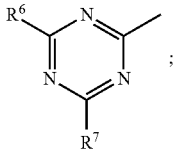

$R^1$ and $R^2$ together represent a linear chain structure in order to build one of the following ring structures including the central sulphur atom of Formula (I)

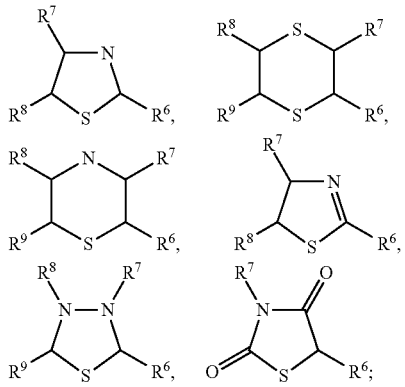

$R^5$ represents —H, —$CH_3$, —$CH_2$—$CH_3$, —$CH_2$—$CH_2$—$CH_3$, —$CH_2$—$CH_2$—$CH_2$—$CH_3$;

$R^6$, $R^7$, $R^8$, $R^9$ represent independently of each other —H, —$NH_2$, —SH, —OH, —$CH_3$, —$CH_2$—$CH_3$, —COOH, —$SO_3H$;

or having the general Formula (II)

Formula (II)

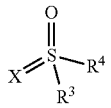

wherein

=X represents =O, a free electron pair;

$R^3$ represents —$R^5$, —CH=$CH_2$, —$CH_2$—CH=$CH_2$, —CH=CH—$CH_3$, —$CH_2$—$CH_2$—CH=$CH_2$, —$CH_2$—CH=CH—$CH_3$, —CH=CH—$CH_2$—$CH_3$, —C≡CH, —$CH_2$—C≡CH, —C≡C—$CH_3$, —$CH_2$—$CH_2$—C≡CH, —$CH_2$—C≡C—$CH_3$, —C≡C—$CH_2$—$CH_3$, —C(—$NH_2$)=NH,

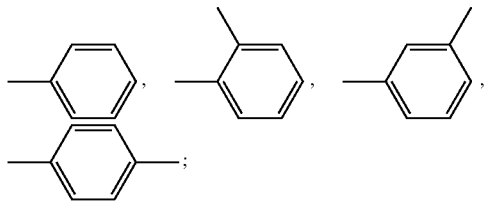

$R^4$ represents —$R^5$, —$OR^5$, —($CH_2$—)$_r$—CH(—$NH_2$)—COOH, —($CH_2$—)$_r$—CH(—NH—$CH_3$)—COOH, —($CH_2$—)$_r$—CH(—N(—$CH_3$)$_2$)—COOH, —($CH_2$—)$_r$—CH(—$NH_2$)—CO—$OCH_3$, —($CH_2$—)$_r$—CH(—$NH_2$)—CO—$OCH_2$—$CH_3$;

r is an integer from 0 to 4;

$R^3$ and $R^4$ together represent a linear chain structure in order to build one of the following ring structures including the central sulphur atom of Formula (II)

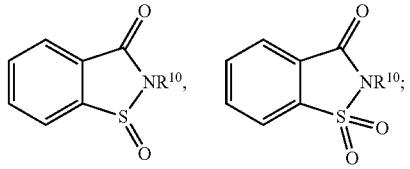

$R^{10}$ represents —H, —$CH_3$, —$CH_2$—$CH_3$, —$CH_2$—$CH_2$—$SO_3H$;

or salts, tautomeric forms, betaine structures thereof; or a mixture of compounds of Formula (I) or salts, tautomeric forms, betaine structures thereof; or a mixture of compounds of Formula (II) or salts, tautomeric forms, betaine structures thereof; and a mixture of compounds of Formulae (I) and (II) or salts, tautomeric forms, betaine structures thereof.

In a preferred embodiment of the present invention the electroplating bath for deposition of a dark chromium layer on a workpiece further comprises chloride ions. This embodiment of the inventive bath is called a chloride based bath or electrolyte throughout the present invention. The chloride based electroplating bath for deposition of a dark chromium layer on a workpiece further may comprise bromide ions and/or ferrous ions.

In a further preferred embodiment of the present invention the electroplating bath for deposition of a dark chromium layer on a workpiece does not comprise halogenide ions, particularly no chloride ions. This embodiment of the inventive bath is called a sulphate based bath or electrolyte throughout the present invention. The sulphate based electroplating bath for deposition of a dark chromium layer on a workpiece is free of halogenide ions, particularly chloride ions and/or bromide ions. The sulphate based electroplating bath for deposition of a dark chromium layer on a workpiece further may comprise sulphate ions and/or ferrous ions.

In a further preferred embodiment of the present invention the sulphate based electroplating bath for deposition of a dark chromium layer on a workpiece comprises a mixture of compounds of Formula (I) or salts, tautomeric forms, betaine structures thereof. In a further preferred embodiment of the present invention the sulphate based electroplating bath for deposition of a dark chromium layer on a workpiece comprises or a mixture of compounds of Formula (II) or salts, tautomeric forms, betaine structures thereof.

In a more preferred embodiment of the present invention the sulphate based electroplating bath for deposition of a dark chromium layer on a workpiece comprises a mixture of compounds of Formulae (I) and (II) or salts, tautomeric forms, betaine structures thereof.

In a further preferred embodiment of the present invention the at least one coloring agent is selected from sulphur containing compounds having the general Formula (I), wherein $R^1$ is not H if $R^2$ is H; or $R^2$ is not H if $R^1$ is H.

In a further preferred embodiment of the present invention the at least one coloring agent is selected from sulphur containing compounds having the general Formula (I a):

Formula (I a)

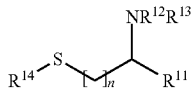

wherein $R^{11}$ represents —COOH, —CO—$OCH_3$, —CO—$OCH_2$—$CH_3$, —$CH_2$—OH;

$R^{12}$ and $R^{13}$ independently of each other represent —H, —$CH_3$;

$R^{14}$ represents —H, —$CH_3$, —$CH_2$—$CH_3$, —$CH_2$—$CH_2$—$CH_3$, —$(CH_2—)_q$—COOH;

n and q have the meanings as defined in Formula (I).

In a further preferred embodiment of the present invention the at least one coloring agent is selected from sulphur containing compounds having the general Formula (II a):

Formula (II a)

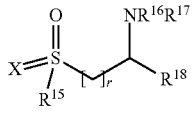

wherein $R^{15}$ represents —H, —$CH_3$, —$CH_2$—$CH_3$, —$CH_2$—$CH_2$—$CH_3$;

$R^{16}$ and $R^{17}$ independently of each other represent —H, —$CH_3$;

$R^{18}$ represents —COOH, —CO—$OCH_3$, —CO—$OCH_2$—$CH_3$;

=X and r have the meanings as defined in Formula (II).

In a more preferred embodiment of the present invention the at least one coloring agent is selected from sulphur containing compounds having the general Formula (I), wherein $R^1$ is —OH, and $R^2$ is selected from the group consisting of —$(CH_2—)_q$—OH, —$(CH_2—)_q$—S—$(CH_2—)_2$—OH;

and q has the meaning as defined in Formula (I).

In a more preferred embodiment of the present invention the at least one coloring agent is selected from sulphur containing compounds having the general Formula (II), wherein $R^3$ and $R^4$ together represent a linear chain structure in order to build one of the following ring structures including the central sulphur atom of Formula (II)

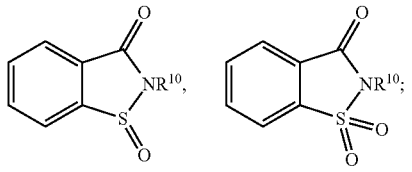

$R^{10}$ represents —H, —$CH_3$, —$CH_2$—$CH_3$ and —$CH_2$—$CH_2$—$SO_3H$.

In the most preferred embodiment of the present invention the at least one coloring agent is selected from the group of sulphur containing compounds comprising:

(1) 2-(2-Hydroxy-ethylsulfanyl)-ethanol,
(2) Thiazolidine-2-carboxylic acid,
(3) Thiodiglycol ethoxylate,
(4) 2-Amino-3-ethylsulfanyl-propionic acid,
(5) 3-(3-Hydroxy-propylsulfanyl)-propan-1-ol,
(6) 2-Amino-3-carboxymethylsulfanyl-propionic acid,
(7) 2-Amino-4-methylsulfanyl-butan-1-ol,
(8) 2-Amino-4-methylsulfanyl-butyric acid,
(9) 2-Amino-4-ethylsulfanyl-butyric acid,
(10) 3-Carbamimidoylsulfanyl-propane-1-sulfonic acid,
(11) 3-Carbamimidoylsulfanyl-propionic acid,
(12) Thiomorpholine,
(13) 2-[2-(2-Hydroxy-ethylsulfanyl)-ethylsulfanyl]-ethanol,
(14) 4,5-Dihydro-thiazol-2-ylamine,
(15) Thiocyanic acid,
(16) 2-Amino-4-methanesulfinyl-butyric acid,
(17) 1,1-Dioxo-1,2-dihydro-1lambda*6*-benzo[d]isothiazol-3-one,
(18) Prop-2-yne-1-sulfonic acid,
(19) Methanesulfinylmethane, and
(20) 2-(1,1,3-Trioxo-1,3-dihydro-1lambda*6*-benzo[d]isothiazol-2-yl)-ethanesulfonic acid.

Thiodiglycol ethoxylate is sold by BASF SE under the trade name Lugalvan® HS 1000. It is prepared by ethoxylation of thiodiglycol under KOH catalysis at a temperature of 130° C. The potassium hydroxide used is neutralized by addition of acetic acid when the ethoxylation is finished. Ethoxylation is known to the person skilled in the art. Thiodiglycol ethoxylate has the following general formula:

$$OH—(CH_2—CH_2—O)_m—CH_2—CH_2—S—CH_2—CH_2—(O—CH_2—CH_2)_m—OH$$

The molecular weight of thiodiglycol ethoxylate is about 1000 g/mol and m is about 10 as disclosed in US 2011/0232679 A1.

Depending on the substituents of the sulphur containing compounds of the present invention, one may be able to form salts with acids or bases. Thus, for example, if there are basic substituents or groups in the sulphur containing molecule, salts may be formed with organic and inorganic acids. Examples of suitable acids for such acid addition salt formation are hydrochloric acid, hydrobromic acid, sulfuric acid, acetic acid, citric acid, formic acid, and other mineral or carboxylic acids well known to those skilled in the art. The salts are prepared by contacting the free base form with a sufficient amount of the desired acid to produce a salt in the conventional manner.

Further, if there are acidic substituents or groups in the sulphur containing molecule, salts may be formed with inorganic as well as organic bases such as, for example, LiOH, NaOH, KOH, $NH_4OH$, tetraalkylammonium hydroxide, and the like.

In the context of the present invention, it is intended to include all stereoisomeric forms of the sulphur containing compounds of the present invention, as well as their quaternary amine, salt, solvate, betaine structure and tautomeric forms, if the said forms and structures are possible for the sulphur containing compounds of the present invention.

The term "stereoisomer" as used herein includes all possible stereoisomeric forms, including all chiral, diastereomeric, racemic forms and all geometric isomeric forms of a sulphur containing compound.

The term "tautomer" as used herein includes all possible tautomeric forms of the sulphur containing compounds of the present invention.

The term "betaine structure" as used herein includes a specific type of zwitterion, i.e. a neutral chemical compound with a positively charged cationic functional group, such as a quaternary ammonium ion which bears no hydrogen atom, and with a negatively charged functional group, such as a carboxylate group, which may not be adjacent to the cationic site.

The concentration of the at least one coloring agent according to Formulae (I) or (II) in the inventive electroplating baths is at least 0.01 g/L, preferably at least 0.05 g/L, more preferably at least 0.1 g/L, even more preferably 0.5 g/L, and most preferably 1 g/L. The concentration of the at least one coloring agent according to Formulae (I) or (II) in the inventive electroplating baths is at most 100 g/L, preferably at most 50 g/L, more preferably at most 25 g/L, even more preferably at most 10 g/L, and most preferably at most 5 g/L.

The addition of a coloring agent selected from sulphur containing compounds according to Formula (I) or Formula (II) or the addition of a mixture of coloring agents selected from sulphur containing compounds according to Formula (I) and/or Formula (II) to the above mentioned electroplating baths results in chromium deposits of very attractive dark color.

Depending on the sulphur containing compound or the mixture of sulfur containing compounds employed within the inventive electroplating baths or by the inventive electrodepositing method the dark color of the resulting chromium deposit varies in darkness or lightness and hue. The dark color of the resulting chromium deposit was measured by a colorimeter and the color is described by the L* a* b* color space system (introduced in 1976 by the Commission Internationale de l'Eclairage). The value L* indicates lightness and a* and b* indicate color directions. A positive value of a* indicates a red color while a negative value of a* means a green color. A positive value of b* indicates a yellow color and a negative value of b* means a blue color. When the absolute values for a* and b* increase the saturation of the colors also increases. The value of L* ranges from zero to 100, wherein zero indicates black and 100 means white. Thus, for the chromium deposits of the present invention a low L* value is desired.

The L* values of chromium deposits from conventional hexavalent chromium baths on top of a bright nickel layer were measured to range between 88 and 87. The L* values of chromium deposits from conventional trivalent chromium baths containing below 120 ppm iron II ions on top of a bright nickel layer were determined to range between 84 and 80. The L* values of chromium deposits from trivalent chromium baths containing between 120 and 450 ppm iron II ions on top of a bright nickel layer were quantified to range between 82 and 78.

The L* values of the dark chromium deposits of the present invention range from <78 to 50, preferably from 75 to 55, more preferably from 70 to 60, even more preferably from 65 to 55, and most preferably from 60 to 50. Thus, the dark color of the dark chromium deposits of the present invention ranges from greyish black to dark grey.

The b* values of the dark chromium deposits of the present invention are in the range of −7.0 to +7.0, preferably in the range of −5.0 to +5.0, and more preferably in the range of −3.0 to +3.0. Thus, the hue of the dark color of the dark chromium deposits of the present invention ranges from yellowish or brownish to bluish or greyish.

The a* values of the dark chromium deposits of the present invention are in the range of −2.0 to +2.0. Thus, the hue of the dark color of the dark chromium deposits of the present invention is nearly unaffected by the a* value and the small deviations of a* within the color of the dark chromium deposits are not visible by the human eye. L*, a* and b* values for chromium deposits produced with an electroplating bath and by a method of the present invention are shown for a spectrum of single colouring agents in Table 1.

The L* values for chromium coatings obtained with the inventive electroplating baths containing one coloring agent only, is always lower than 78. Thus, the chromium coatings obtained with the inventive electroplating baths containing one coloring agent are always darker than the chromium coating resulting from an electroplating bath without any of the coloring agents of the present invention. In addition the chromium coatings obtained with the inventive electroplating baths containing one coloring agent are also darker than coatings resulting from conventional hexavalent or trivalent chromium baths or from chromium baths containing iron II ions mentioned above.

The dark color of the dark chromium deposits resulting from electrodeposition baths containing more than one coloring agent is always darker than chromium deposits obtained with an electrodeposition bath containing one coloring agent only, when applied in similar concentrations.

In a further preferred embodiment of the present invention the electroplating baths comprise mixtures of two or more coloring agents selected from the group of sulphur containing compounds according to Formula (I). More preferred are mixtures of two or more coloring agents selected from the group of sulphur containing compounds according to Formula (I), wherein at least one coloring agent is selected from the group of sulphur containing compounds: (1), (7), (8), (9), (10), (13), (14), and (15). Most preferred are mixtures of two or more coloring agents selected from the group of sulphur containing compounds according to Formula (I), wherein at least one coloring agent is selected from the group of sulphur containing compounds: (1), (8), (13), and (15).

In a further preferred embodiment of the present invention the electroplating baths comprise mixtures of two or more coloring agents selected from the group of sulphur containing compounds according to Formula (II). More preferred are mixtures of two or more coloring agents selected from the group of sulphur containing compounds according to Formula (II), wherein at least one coloring agent is selected from the group of sulphur containing compounds: (16), (17) and (20). Most preferred are mixtures of two or more coloring agents selected from the group of sulphur containing compounds according to Formula (II), wherein at least one coloring agent is selected from the group of sulphur containing compounds: (16) and (17).

In a further preferred embodiment of the present invention the electroplating bath comprises mixtures of one or more coloring agents selected from the group of sulphur containing compounds according to Formula (I) with one or more coloring agents selected from the group of sulphur containing compounds according to Formula (II). More preferred are mixtures of two or more coloring agents selected from the group of sulphur containing compounds according to Formula (I) and Formula (II), wherein at least one coloring agent is selected from the group of sulphur containing compounds: (1), (7), (8), (9), (10), (13), (14) and (15). In addition more preferred are mixtures of two or more coloring agents selected from the group of sulphur containing compounds according to Formula (I) and Formula (II), wherein at least one coloring agent is selected from the group of sulphur containing compounds: (16), (17) and (20). Even More preferred are mixtures of compounds (1), (7), (8), (9), (10), (13), (14), and (15) with any of compounds (16), (17) and (20). Most preferred are mixtures of compounds (1) and/or (8) with (15) and/or (17).

The addition of more than one coloring agent, i.e. a mixture of coloring agents, selected from sulphur containing compounds according to Formula (I) and/or Formula (II) to the above mentioned electroplating baths as well results in chromium deposits of very attractive dark color. If a mixture of sulphur containing compounds according to Formula (I) and/or Formula (II) is present in the inventive electroplating baths, the dark color of the inventive chromium deposits is even darker or is changed in hue in comparison to the inventive electroplating baths containing one coloring agent only.

L*, a* and b* values for chromium deposits produced with a chloride based electroplating bath and by a method of the present invention using mixtures of colouring agents are given in Tables 2 to 5 and 7.

L*, a* and b* values for chromium deposits produced with a sulphate based electroplating bath and by a method of the present invention using mixtures of colouring agents are given in Example 8 and Table 8.

Furthermore the deposition of chromium by the electroplating baths and electroplating method of the present invention yields a uniform distribution of the dark color onto flat plated workpieces as well as on workpieces with a complex structured surface. This is shown in Example 5 and Table 5.

Moreover, the structure, i.e. the glossy or dull appearance, of the surface of the workpiece or of an additional at least one metal layer lying on top of the surface of the workpiece and underneath the inventive dark chromium layer is preserved by employing the constituents of the inventive electroplating baths and inventive electroplating method within certain concentration ranges as described herein. Thus, the electroplating baths and electroplating method of the present invention are also suited to produce dark chromium layers on workpieces, wherein the dark chromium layers present different grades of dull or matt appearance. Preferably, the electroplating baths and electroplating method of the present invention are employed to generate a glossy or bright dark chromium layer onto workpieces.

The inventive electroplating baths further comprise trivalent chromium ions. The concentration of the trivalent chromium ions in the electroplating baths ranges from 5 g/L to 25 g/L, more preferably from 5 g/L to 20 g/L and most preferably from 8 g/L to 20 g/L. The concentration of the trivalent chromium ions in the chloride based electroplating baths ranges from 15 g/L to 25 g/L, more preferably from 18 g/L to 22 g/L and most preferably is 20 g/L. The concentration of the trivalent chromium ions in the sulphate based electroplating baths ranges from 5 g/L to 20 g/L, more preferably from 5 g/L to 15 g/L and most preferably from 8 g/L to 20 g/L. The trivalent chromium ions can be introduced in the form of any bath soluble and compatible salt such as chromium chloride hexahydrate, chromium sulphate, chromium formate, chromium acetate, basic chromium sulphate ($Cr_2(SO_4)_3.12(H_2O)$), chrome alum ($KCr(SO_4)_2.12(H_2O)$), and the like. Preferably, the chromium ions are introduced as basic chromium sulfate.

Preferably the electroplating baths are substantially free of hexavalent chromium, and preferably the chromium in the solution is substantially present as trivalent chromium prior to plating.

The inventive electroplating bath further comprises carboxylate ions. The carboxylate ions act as a complexing agent for complexing the chromium ions present maintaining them in solution. The carboxylate ions comprise formate ions, acetate ions, citrate ions, malate ions or mixtures thereof, of which the formate ion or the malate ion are preferred. In chloride based electroplating baths the carboxylate ions comprise formate ions, acetate ions, citrate ions or mixtures thereof, of which the formate ion is preferred. In sulphate based electroplating baths the carboxylate ions comprise citrate ions, malate ions or mixtures thereof, of which the malate ion is preferred. The carboxylate ions are employed in concentrations ranging from 5 g/L to 35 g/L, more preferably from 8 g/L to 30 g/L, most preferably from 8 g/L to 25 g/L. In chloride based electroplating baths the carboxylate ions are employed in concentrations ranging from 15 g/L to 35 g/L, more preferably from 20 g/L to 30 g/L. In sulphate based electroplating baths the carboxylate ions are employed in concentrations ranging from 5 g/L to 35 g/L, more preferably from 8 g/L to 20 g/L. A molar ratio of carboxylate groups to chromium ions of 1:1 to 1.5:1 is used with ratios of 1.1:1 to 1.2:1 preferred. Amino acids like glycine or aspartic acid may also be employed as complexing agents.

The inventive electroplating baths further comprises at least one pH buffer substance. The at least one pH buffer substance used in the electroplating baths may be any substance exhibiting pH buffering properties, such as boric acid, sodium borate, a carboxylic acid, a complexing agent, an amino acid, and aluminum sulfate, more preferably boric acid or sodium borate. The concentration of the pH buffer substance in the electroplating bath ranges from 50 g/L to 250 g/L, more preferably from 50 g/L to 150 g/L. In the case of boric acid or sodium borate the concentration of borate ions ranges from 50 g/L to 70 g/L, more preferably from 55 g/L to 65 g/L.

In a further preferred embodiment of the present invention the chloride based electroplating bath further comprises chloride ions. The amount may vary up to the maximum permitted by solubility considerations. Chloride is generally introduced into the bath as the anion of the conductivity salt, e.g., sodium chloride, potassium chloride, ammonium chloride; as chromium chloride which may optionally be used to supply at least part of the chromium requirement, and/or as hydrochloric acid, which is a convenient means of adjusting the pH of the bath. The chloride content ranges from 50 g/L to 200 g/L, more preferably from 100 g/L to 150 g/L.

In a further preferred embodiment of the present invention the chloride based electroplating bath further comprises bromide ions. The concentration of the bromide ions in the electroplating bath ranges from 5 g/L to 20 g/L, more preferably from 10 g/L to 15 g/L. The bromide ions can be introduced in the form of any bath soluble salt, such as ammonium bromide, potassium bromide, and sodium bromide.

In a further preferred embodiment of the present invention the electroplating baths further comprise ferrous ions. The concentration of ferrous ions in the electroplating bath ranges from 40 mg/L to 280 mg/L. The ferrous ions can be introduced in the form of any bath soluble salt, such as ferrous sulphate. Ferrous ions are preferably used in chloride based trivalent chromium electroplating baths of the present invention.

Ferrous ions have several beneficial effects on the plating performance and on the chromium deposits achieved by the inventive electroplating baths.

If the inventive electrolyte contains additionally ferrous ions the deposition rate of chromium is enhanced. This is shown by Example 6 in which the base electrolyte of Example 1 (chloride based) additionally containing coloring agent (17) was used. The thickness of each resulting chromium layer and its content of co-deposited iron was measured by X-ray fluorescence spectrometry (XRF spectrometry), which is well known to persons skilled in the art. Details of XRF spectrometry measurements are described in Example 6.

If the electrolyte did not contain ferrous ions the achieved chromium layer was only 0.06 μm thick (Table 6). If the electrolyte contained 200 mg/L ferrous ions but no coloring agent the chromium layer achieved a much higher thickness of 0.88 μm. Interestingly, if the electrolyte contained the same amount of ferrous ions plus coloring agent (17) the achieved chromium layer had also a higher thickness (0.21 μm) than without ferrous ions. Thus, the coloring agent seems to reduce the deposition rate of chromium. In contrast, the ferrous ions enhance the deposition rate and this effect is still active in the presence of a coloring agent. Thus, the ferrous ions beneficially counteract and overrule the effect of the coloring agent on the deposition rate.

Further the presence of ferrous ions in the inventive electrolyte has beneficial effects on the deposited chromium layers. If the inventive electrolyte, particularly the chloride based electrolyte, contains additionally ferrous ions several defects of the chromium layers are prevented, like white haze at areas of high current density and streaky or stained appearance of the chromium layers. Instead the chromium layers are uniformly deposited with a good throwing power and show a uniform color and hue.

Additionally ferrous ions present in the inventive electrolytes contribute to the dark color of the chromium deposits. It was already mentioned that the L* values of chromium deposits from trivalent chromium baths containing ferrous ions on top of a bright nickel layer range between 84 and 78. In Example 7 the base electrolyte of Example 1 was used with different concentrations of ferrous ions while the concentration of one or more coloring agents was kept constant. In addition, chromium layers were deposited from the base electrolyte of Example 1 having neither coloring agents nor ferrous ions as a comparative example. The L*, a* and b* values of the chromium layers deposited from these electrolytes were measured (Table 7). The L* value for the comparative example was 82.6. The L* values of the deposits from the electrolyte containing one or more coloring agents (no ferrous ions) are usually about 10 units or even more lower than the L* value of the control experiment. Thus, the chromium deposits resulting from electrolytes containing coloring agents but no ferrous ions are already much darker than the comparative example. The L* values of deposits from the electrolyte containing ferrous ions in addition to coloring agents show that the chromium deposits become darker with increasing concentration of ferrous ions. Thus, ferrous ions contribute to the dark color of the chromium deposits even in the presence of coloring agents.

This is further supported by the findings presented in Example 6 (see above). In this Example also the content of iron codeposited into the chromium layers was measured. Chromium layers deposited from the electrolyte containing 200 mg/L ferrous ions but no coloring agent showed an iron content between 7.5 and 7.8%. The same electrolyte containing a coloring agent in addition to ferrous ions resulted in a chromium deposit containing about 3 times as much iron. This unexpected high increase in codeposition of iron in a chromium deposit when a coloring agent of the present invention is present in the electrolyte additionally contributes to the dark color of the chromium deposits of the present invention.

Thus, the contribution of the ferrous ions to the darker color of the chromium deposits of the present invention is not only due to the already known effect of ferrous ions to produce a darker hue in chromium deposits. The dark color of the chromium deposit of the present invention is also based on a synergistic effect between ferrous ions and the coloring agents within a bath of the present invention resulting in a considerable higher amount of codeposited iron.

The beneficial effects of ferrous ions in the electroplating baths of the present invention are mainly observed when the ferrous ions are in the concentration range given above. Depositing dark chromium layers from the inventive electrolyte is also possible without ferrous ions or with ferrous ions below or above the described concentration range. But in case of chloride based electrolytes the resulting chromium layers often show the defects described above.

Additionally, the electroplating bath further comprises controlled amounts of conductivity salts which usually comprise salts of alkali metal or alkaline earth metals and strong acids such as hydrochloric acid and sulphuric acid. Among suitable conductivity salts are potassium and sodium sulphates and chlorides as well as ammonium chloride and ammonium sulphate. Conductivity salts are usually employed in amounts ranging from 1 g/L to 300 g/L or higher to obtain the requisite conductivity.

The electroplating bath may further comprise at least one surfactant. The at least one surfactant used in the electroplating bath is typically cationic or preferably anionic, e.g., sulphosuccinates such as sodium diamyl sulphosuccinate, alkyl benzene sulphonates having from 8 to 20 aliphatic carbon atoms, such as sodium dodecyl benzene sulphonate; alkyl sulphates having from 8 to 20 carbon atoms, such as sodium lauryl sulphate; alkyl ether sulphates, such as sodium lauryl polyethoxy sulphates; and fatty alcohols such as octyl alcohol. However, it has been determined that the exact nature of the surfactant is not critical to the performance of the electroplating bath of the present invention. The concentration of the surfactant in the electroplating bath is employed in amounts ranging from 0.001 g/L to 0.05 g/L, more preferably from 0.005 g/L to 0.01 g/L.

The pH value of the electroplating bath is between 2.0-4.0. If the inventive electroplating bath is free of halogenide ions, particularly of chloride ions, the pH value is preferably between 3.0 and 4.0, more preferably between 3.4-3.6. If the inventive electroplating bath also contains chloride ions the pH value is preferably between 2.5-3.2, more preferably between 2.6-3.1. The pH value of the electroplating bath is adjusted with hydrochloric acid, sulphuric acid, ammonia, potassium hydroxide or sodium hydroxide.

The electroplating baths of the present invention do not comprise cobalt, nickel, fluoride or phosphate ions. The inventive electroplating baths do also not comprise compounds containing fluorine or phosphorus. The dark chromium deposits of the present invention are solely obtained by the inventive electroplating baths comprising the coloring agents according to Formulae (I) and (II) and optionally ferrous ions. Neither nickel, cobalt, fluorine nor phosphorous containing compounds are required to obtain the dark chromium deposits by the electroplating baths and method of the present invention.

The above described components of the inventive electroplating baths are dissolved in water.

The electroplating baths may be made up by dissolving water soluble salts of the required species in water in an amount sufficient to provide the desired concentration. The cationic species may, if desired be added wholly or partly as bases such as, for example, aqueous ammonia. The anion species may be added, at least in part as acids, e.g., hydrochloric, sulphuric, boric, formic, acetic acid, malic acid or citric acid. The bath may be prepared at elevated temperature.

In a further preferred embodiment of the present invention the electroplating baths are made up as follows. At first, the pH buffer substance is dissolved in ⅔ of the required water at 60° C. Then, the conductivity salts and the chromium salt are added while the solution is cooling down to 35° C. Then, the carboxylic acid, optionally iron salt and surfactant are added and the pH is adjusted to the range between 2.6 and 3.2 for the chloride based electroplating bath and to 3.0 to 4.0 for the sulphate based electroplating bath. The electrolyte is ready to use after addition of the sulphur containing compound or sulphur containing compounds and subsequent adjustment of pH to the ranges given above.

The present invention further relates to a method for electrodepositing a dark chromium layer on a workpiece. The method for electrodepositing a dark chromium layer comprises electroplating said workpiece with an inventive electroplating bath as defined above. The method for electrodepositing a dark chromium layer generates dark chromium layers on workpieces with L*, b* and a* values as described above.

In more detail the inventive method for electrodepositing a dark chromium layer comprises the steps of (i) providing a workpiece, (ii) contacting the workpiece with the inventive electroplating bath as defined above, and (iii) cathodically electrifying the workpiece.

The method for electrodepositing a dark chromium layer may also comprise additional steps like cleaning the workpiece, a pre-treatment for activation, a pre-treatment to provide at least one additional metal layer on the workpiece, a post-treatment of the dark chromium deposit in order to enhance corrosion resistance.

Thus, the inventive method for electrodepositing a dark chromium layer may comprise the steps of (i) providing a workpiece, (ii) coating the workpiece with at least one additional metal layer by electrolytic or electroless means, (iii) contacting the workpiece with the inventive electroplating bath as defined above, and (iv) cathodically electrifying the workpiece.

Step (ii) may be repeated according to the desired number of additional metal layers coated onto the workpiece prior to electrodepositing the inventive dark chromium layer.

The workpiece may be cleaned by electrolytic degreasing.

Alternatively, the workpiece can be exposed to 10% sulphuric acid by volume for activation before it is contacted with the electroplating bath according to the invention. The workpieces to be electroplated for depositing a dark chromium layer are subjected to conventional pre-treatments in accordance with well-known prior art practices. The pre-treatment may comprise coating the workpiece with at least one additional metal layer, i.e. one metal layer or a sequence of several different metal layers, by electrolytic or electroless means. The at least one additional metal layer may comprise chromium, palladium, silver, tin, copper, zinc, iron, cobalt or nickel or an alloy thereof; preferably nickel. The surface of the at least one additional metal layer may exhibit different appearances or structures, such as glossy or bright; matt, dull or rough, micro porous or micro cracked. The appearance or structure of the last additional metal layer is preserved by the dark chromium layer obtained by the inventive electroplating bath and inventive electroplating method. The last additional metal layer is the one lying directly on top of the surface of the workpiece or on top of a stack of several additional metal layers already coated onto the workpiece, and underneath the inventive dark chromium layer. If the inventive dark chromium layer is deposited onto the surface of the workpiece or the surface of the last additional metal layer having a matt structure or appearance, the inventive dark chromium layer preserves the matt structure or appearance of the underlying surface. Examples for a last additional metal layer having a matt structure or appearance are a matt nickel layer or a matt copper layer. If the inventive dark chromium layer is deposited onto the surface of the workpiece or the surface of the last additional metal layer having a glossy structure or appearance, the inventive dark chromium layer preserves the glossy structure or appearance of the underlying surface.

The electroplating bath and method of the present invention are particularly effective for electrodepositing dark chromium layers on workpieces which have been subjected to at least one prior nickel plating operation. The electroplating bath and method of the present invention are especially effective for electrodepositing bright dark chromium layers on workpieces which have been subjected to a prior bright nickel plating operation.

Thus, the workpiece can be subjected to suitable pre-treatment according to well-known techniques to provide at least one nickel layer by electrolytic or electroless means before it is contacted with the electroplating bath according to the invention.

Optionally, the dark chromium deposit is post-treated with a post dip and dried afterwards for enhancing corrosion resistance.

Rinsing with water between each process step is suitable followed by drying after the last rinsing.

The workpiece may comprise different substrates, e.g. electrically conductive substrates or non conductive substrates. The method of the present invention can be employed for electrodepositing dark chromium layers on conventional ferrous or nickel substrates, stainless steels as well as non-ferrous substrates such as copper, nickel, aluminum, zinc, or alloys thereof. The method of the present invention can also be employed for electrodepositing dark chromium layers on plastic substrates which have been subjected to a suitable pretreatment according to well-known techniques to provide an electrically conductive coating thereover such as a nickel layer or a copper layer. Such plastics include ABS, polyolefin, PVC, and phenol-formaldehyde polymers.

The workpiece is contacted with the electroplating baths according to the present invention by dipping the substrate into the electroplating bath.

The workpiece is cathodically electrified for electrodepositing dark chromium layers and electrodepositing is continued until the desired dark color is obtained and/or the desired thickness is obtained. This is obtained by contacting the workpiece with an inventive electroplating bath and cathodically electrifying the workpiece for 2 minutes to 7 minutes, preferably 3 minutes to 5 minutes.

The thickness of the resulting dark chromium layers ranges from 0.05 μm to 1 μm, preferably from 0.1 μm to 0.7 μm and more preferably from 0.15 μm to 0.3 μm, and even more preferably from 0.3 μm to 0.5 μm.

Cathode current densities during electrodepositing dark chromium layers can range from 5 to 25 amperes per square decimeter ($A/dm^2$), preferably the current densities range from 5 $A/dm^2$ to 20 $A/dm^2$. Cathode current densities during electrodepositing dark chromium layers from chloride based electroplating baths can range from 5 to 25 $A/dm^2$, preferably from 10 $A/dm^2$ to 20 $A/dm^2$. Cathode current densities during electrodepositing dark chromium layers from sulphate based electroplating baths can range from 5 to 10 $A/dm^2$.

Anodes usually employed for electrodepositing dark chromium layers are inert anodes such as graphite, platinized titanium, platinum, or platinum- or iridiumoxide-coated titanium anodes. Anodes usually employed for electrodepositing dark chromium layers from chloride based electroplating baths are graphite, platinized titanium or platinum anodes. Anodes usually employed for electrodepositing dark chromium layers from sulphate based electroplating baths are platinized titanium or platinum- or iridiumoxide-coated titanium anodes.

The temperature of the electroplating bath is held during electroplating in a range from 30° C. to 60° C., preferably 30° C. to 40° C., and preferably 50° C. to 60° C. The temperature of the chloride based electroplating bath is held during electroplating in a range from 30° C. to 40° C., preferably 30° C. to 35° C. The temperature of the sulphate based electroplating bath is held during electroplating in a range from 50° C. to 60° C., preferably 53° C. to 57° C.

It is to be understood that here and elsewhere in the specification and claims, the range and ratio limits may be combined.

The present invention further relates to a workpiece obtainable by a method for electrodepositing a dark chromium layer on a workpiece as described above.

The present invention relates also to a dark chromium layer on a workpiece obtainable by a method for electrodepositing a dark chromium layer on a workpiece as described above.

The present invention further relates to a dark chromium layer on a workpiece, wherein the dark chromium layer has a dark color with a L* value ranging from <78 to 50, a b* value ranging from −7.0 to +7.0, and an a* value ranging from −2.0 to +2.0.

Further the invention relates to dark chromium deposits and workpieces carrying dark chromium deposits as well as their application for decorative purposes. Applications for dark chromium deposits and workpieces carrying dark chromium deposits of the present invention include shop fittings, sanitary fittings (such as taps, faucets and shower fixings), automobile parts (such as bumpers, door handles, grilles and other decorative trim), home furnishings, hardware, jewelry, audio and video components, hand tools, musical instruments and so on.

In order to illustrate further the composition and process of the present invention, the following specific examples are provided. It will be understood that the examples are provided for illustrative purposes and are not intended to be limiting of the invention as herein disclosed and as set forth in the subjoined claims.

EXAMPLES

Example 1

Deposition of Dark Chromium Layers by Chloride Based Electroplating Baths Containing One Coloring Agent Each Copper panels (99 mm×70 mm) were used as workpieces.

Cleaning:

The copper panels were firstly cleaned by electrolytic degreasing with Uniclean® 279 (product of Atotech Deutschland GmbH), 100 g/L at room temperature (RT). Afterwards the copper panels were pickled with 10% $H_2SO_4$ by volume and rinsed with water.

Nickel Plating:

The cleaned copper panels were plated with a bright nickel layer for 10 min at 4 A/dm$^2$ with a Makrolux® NF electrolyte (product of Atotech Deutschland GmbH).

Deposition of Bright Dark Chromium Layer:

A base electroplating bath was prepared consisting of the following ingredients:

60 g/L Boric acid
12 g/L Ammonium bromide
100 g/L Ammonium chloride
110 g/L Potassium chloride
128 g/L Basic chromium sulphate
22 g/L Formic acid
0.1 g/L Sodium diamyl sulphosuccinate
0.43 g/L Fe $SO_4.7H_2O$ The pH value was adjusted to 2.7 with 32% hydrochloric acid or 33% ammonia.

A coloring agent of the present invention was added to the base electroplating bath at a concentration as outlined in Table 1.

The electroplating bath containing a coloring agent was introduced into a Hull cell having a graphite anode and a nickel plated copper panel was installed as the cathode. A plating current of 5 A was passed through the solution for 3 minutes at 35° C. Dark chromium was deposited from about 10 A/dm$^2$ to the top of the nickel plated copper panel. Afterwards the chromium plated panels were rinsed with water.

As a comparative example a chromium layer was deposited onto the nickel plated copper panel using the same conditions as described above but in absence of any coloring agent.

The color of the chromium layers obtained on the nickel plated copper panels were measured by a colorimeter (Dr. Lange LUCI 100). Calibration was done with black and white standard. Color measurement was done at an area in the center of the panels. The measuring area lies on the panel 2 cm to 3 cm from the lower edge and 3 cm to 4 cm from the edge of the panel which is next to the anode. The center of the panels corresponds to the medium current density (MCD) area of the panels. The resulting L*, a* and b* values are shown in Table 1.

TABLE 1

Color of the dark chromium layer obtained for one coloring agent each present in the inventive electroplating bath.

| No. | Coloring Agent | Concentration g/L | Color L* a* b* |
|---|---|---|---|
| (1) | 2-(2-Hydroxy-ethylsulfanyl)-ethanol | 23.6 g/L | 76.5<br>0.0<br>0.8 |
| (2) | Thiazolidine-2-carboxylic acid | 0.3 g/L | 78.0<br>0.0<br>0.8 |
| (3) | Thiodiglycol ethoxylate | 5 g/L | 71.2<br>0.2<br>2.4 |
| (4) | 2-Amino-3-ethylsulfanyl-propionic acid | 2 g/L | 70.6<br>−0.2<br>0.8 |
| (5) | 3-(3-Hydroxy-propylsulfanyl)-propan-1-ol | 4.8 g/L | 71.8<br>−0.2<br>0.6 |
| (6) | 2-Amino-3-carboxymethylsulfanyl-propionic acid | 0.2 g/L | 78.0<br>−0.0<br>0.6 |
| (7) | 2-Amino-4-methylsulfanyl-butan-1-ol | 1.8 g/L | 75.9<br>0.0<br>1.0 |
| (8) | 2-Amino-4-methylsulfanyl-butyric acid | 4.1 g/L | 69.3<br>0.0<br>0.1 |
| (9) | 2-Amino-4-ethylsulfanyl-butyric acid | 1.0 g/L | 72.8<br>0.0<br>0.7 |
| (10) | 3-Carbamimidoylsulfanyl-propane-1-sulfonic acid | 0.2 g/L | 73.0<br>0.3<br>2.3 |

TABLE 1-continued

Color of the dark chromium layer obtained for one coloring agent each present in the inventive electroplating bath.

| No. | Coloring Agent | Concentration g/L | Color L* a* b* |
|---|---|---|---|
| (11) | 3-Carbamimidoylsulfanyl-propionic acid | 0.5 g/L | 69.8<br>0.3<br>2.7 |
| (12) | Thiomorpholine, | 3 g/L | 73.7<br>0.1<br>1.1 |
| (13) | 2-[2-(2-Hydroxy-ethylsulfanyl)-ethylsulfanyl]-ethanol | 1.2 g/L | 71.3<br>0.0<br>1.5 |
| (14) | 4,5-Dihydro-thiazol-2-ylamine | 0.1 g/L | 76.3<br>0.1<br>1.3 |
| (15) | Sodium thiocyanate | 1.5 g/L | 65.5<br>0.6<br>4.3 |
| (16) | 2-Amino-4-methanesulfinyl-butyric acid | 2.0 g/L | 74.6<br>0.0<br>0.8 |
| (17) | 1,1-Dioxo-1,2-dihydro-1lambda*6*-benzo[d]isothiazol-3-one | 2 g/L | 72.4<br>0.4<br>2.9 |
| (18) | Sodium prop-2-yne-1-sulfonate | 0.5 g/L | 73.8<br>0.1<br>1.3 |
| (19) | Methanesulfinylmethane | 1.5 g/L | 76.7<br>0.1<br>1.5 |
| (20) | 2-(1,1,3-Trioxo-1,3-dihydro-1lambda*6*-benzo[d]isothiazol-2-yl)-ethanesulfonic acid | 3 g/L | 73.6<br>0.4<br>2.0 |
| | Comparative Example | — | 82.8<br>0.1<br>0.8 |

The chromium layer obtained with the electroplating bath containing no coloring agent as a comparative example has a L* value of 82.8. The L* value for chromium coatings obtained with the inventive electroplating bath containing one coloring agent is always lower than 78. Thus, the chromium coatings obtained with the inventive electroplating bath containing one coloring agent are always darker than that resulting from the comparative example. In addition the chromium coatings obtained with the inventive electroplating bath containing one coloring agent are also darker than coatings resulting from conventional hexavalent or trivalent chromium baths or from chromium baths containing iron II ions as described at page 15.

The chromium coatings obtained with the inventive electroplating bath containing one coloring agent are as well glossy.

Example 2

Deposition of Dark Chromium Layers by Chloride Based Electroplating Baths Containing a Mixture of Coloring Agents According to Formula (I)

Mixtures of coloring agents according to Formula (I) (Table 2) were added to the base electroplating bath as described in Example 1. Unlike the base electroplating bath described in Example 1 the base electroplating bath of this Example 2 contained 1.1 g/L Fe $SO_4.7H_2O$. The resulting baths were used to deposit a bright dark chromium layer on nickel plated copper panels in the same way as described in Example 1. The L*, a* and b* values measured for the obtained bright dark chromium deposits at the MCD area of the panels are shown in Table 2.

TABLE 2

Color of the dark chromium layer obtained for a mixture of coloring agents according to Formula (I) present in the inventive electroplating bath.

| Mixture | Coloring Agent | Concentration g/L | Color L* a* b* |
|---|---|---|---|
| A | (13) 2-[2-(2-Hydroxy-ethylsulfanyl)-ethylsulfanyl]-ethanol | 1.2 | 67.9<br>0.0<br>0.7 |
| | (8) 2-Amino-4-methylsulfanyl-butyric acid | 2.5 | |
| B | (1) 2-(2-Hydroxy-ethylsulfanyl)-ethanol | 11.8 | 63.7<br>0.2 |
| | (8) 2-Amino-4-methylsulfanyl-butyric acid | 10.0 | 2.5 |

The L* values of chromium layers obtained with electroplating baths containing a mixture of coloring agents according to Formula (I) are well below 70. Thus, the chromium layers obtained with the inventive electroplating bath containing mixtures of coloring agents according to Formula (I) are always darker than the chromium layer resulting from the comparative example. Additionally, the chromium layers obtained with the inventive electroplating bath containing mixtures of coloring agents according to Formula (I) are much darker than the chromium deposits obtained with the inventive electroplating baths containing one coloring agent only.

In addition the chromium layers obtained with the inventive electroplating bath containing a mixture of coloring agents according to Formula (I) are as well glossy.

Example 3

Deposition of Dark Chromium Layers by Chloride Based Electroplating Baths Containing a Mixture of Coloring Agents According to Formula (II)

Mixtures of coloring agents according to Formula (II) (Table 3) were added to the base electroplating bath as described in Example 1. Unlike the base electroplating bath described in Example 1 the base electroplating bath of this Example contained 1.1 g/L Fe $SO_4.7H_2O$. The resulting baths were used to deposit a bright dark chromium layer on nickel plated copper panels in the same way as described in Example 1. The L*, a* and b* values measured for the obtained bright dark chromium deposits at the MCD area of the panels are shown in Table 3.

TABLE 3

Color of the dark chromium layer obtained for a mixture of coloring agents according to Formula (II) present in the inventive electroplating bath.

| Mixture | Coloring Agent | Concentration g/L | Color L* a* b* |
|---|---|---|---|
| C | (16) 2-Amino-4-methanesulfinyl-butyric acid | 3.0 | 67.3<br>0.3 |
| | (17) sodium salt of 1,1-Dioxo-1,2-dihydro-1lambda*6*-benzo[d]isothiazol-3-one•2 $H_2O$ | 2.1 | 2.8 |

TABLE 3-continued

Color of the dark chromium layer obtained for a mixture of coloring agents according to Formula (II) present in the inventive electroplating bath.

| Mixture | Coloring Agent | Concentration g/L | Color L* a* b* |
|---|---|---|---|
| D | (16) 2-Amino-4-methanesulfinyl-butyric acid | 3.0 | 66.5 0.6 |
| | (17) sodium salt of 1,1-Dioxo-1,2-dihydro-1lambda*6*-benzo[d]isothiazol-3-one•2 $H_2O$ | 2.1 | 3.8 |
| | (15) Sodium thiocyanate | 1.0 | |

The L* values of chromium layers obtained with electroplating baths containing a mixture of coloring agents according to Formula (II) are well below 70. Thus, the chromium layers obtained with the inventive electroplating bath containing mixtures of coloring agents according to Formula (II) are always darker than the chromium layer resulting from the comparative example. Additionally, the chromium layers obtained with the inventive electroplating bath containing mixtures of coloring agents according to Formula (II) are much darker than the chromium deposits obtained with the inventive electroplating baths containing one coloring agent only.

In addition the chromium layers obtained with the inventive electroplating bath containing a mixture of coloring agents according to Formula (II) are as well glossy.

Example 4

Deposition of Dark Chromium Layers by Chloride Based Electroplating Baths Containing a Mixture of Coloring Agents According to Formula (I) and Coloring Agents According to Formula (II)

Mixtures of coloring agents according to Formula (I) and Formula (II) (Table 4) were added to the base electroplating bath as described in Example 1. Unlike the base electroplating bath described in Example 1 the base electroplating bath of this Example contained 1.1 g/L Fe $SO_4.7H_2O$. The resulting baths were used to deposit a bright dark chromium layer on nickel plated copper panels in the same way as described in Example 1. The L*, a* and b* values measured for the obtained bright dark chromium deposits at the MCD area of the panels are shown in Table 4.

TABLE 4

Color of dark chromium layers obtained for a mixture of coloring agents according to Formula (I) and Formula (II) present in the inventive electroplating bath.

| Mixture | Formula | Coloring Agent | Concentration g/L | Color L* a* b* |
|---|---|---|---|---|
| E | (I) | (8) 2-Amino-4-methylsulfanyl-butyric acid | 2.5 | 66.0 0.1 |
| | (II) | (17) sodium salt of 1,1-Dioxo-1,2-dihydro-1lambda*6*-benzo[d]isothiazol-3-one•2 $H_2O$ | 1.5 | 1.4 |
| F | (I) | (1) 2-(2-Hydroxy-ethylsulfanyl)-ethanol | 11.8 | 66.8 0.2 |

TABLE 4-continued

Color of dark chromium layers obtained for a mixture of coloring agents according to Formula (I) and Formula (II) present in the inventive electroplating bath.

| Mixture | Formula | Coloring Agent | Concentration g/L | Color L* a* b* |
|---|---|---|---|---|
| | (I) | (8) 2-Amino-4-methylsulfanyl-butyric acid | 2.5 | 2.1 |
| | (II) | (17) sodium salt of 1,1-Dioxo-1,2-dihydro-1lambda*6*-benzo[d]isothiazol-3-one•2 $H_2O$ | 1.0 | |
| G | (I) | (1) 2-(2-Hydroxy-ethylsulfanyl)-ethanol | 4.0 | 61.0 0.3 |
| | (I) | (8) 2-Amino-4-methylsulfanyl-butyric acid | 10.0 | 2.7 |
| | (II) | (17) sodium salt of 1,1-Dioxo-1,2-dihydro-1lambda*6*-benzo[d]isothiazol-3-one•2 $H_2O$ | 2.7 | |
| H | (I) | (1) 2-(2-Hydroxy-ethylsulfanyl)-ethanol | 4.0 | 59.7 0.6 |
| | (I) | (8) 2-Amino-4-methylsulfanyl-butyric acid | 10.0 | 4.1 |
| | (I) | (15) Sodium thiocyanate | 1.72 | |
| | (II) | (17) sodium salt of 1,1-Dioxo-1,2-dihydro-1lambda*6*-benzo[d]isothiazol-3-one•2 $H_2O$ | 2.7 | |

The L* values of chromium layers obtained with electroplating baths containing a mixture of coloring agents according to Formula (I) and Formula (II) are well below 70. Thus, the chromium layers obtained with the inventive electroplating bath containing a mixture of coloring agents according to Formula (I) and Formula (II) are always darker than the chromium layer resulting from the comparative example. Additionally, the chromium layers obtained with the inventive electroplating bath containing a mixture of coloring agents according to Formula (I) and Formula (II) are much darker than the chromium deposits obtained with the inventive electroplating baths containing one coloring agent only.

In addition, the deposition experiments show that the chromium deposits become darker the more different coloring agents are present within the electroplating bath. While mixtures E and F containing two and three coloring agents respectively caused L* values of about 66, mixture H containing 4 coloring agents leads to a chromium deposit with a L* value of 59.5, that is even below 60 and thus very dark.

Moreover, the concentration or the ratio of the coloring agents within the electroplating bath has also an effect on the lightness of the resulting chromium layers. Mixtures F and G contain the same coloring agents but the concentrations of the coloring agents differ from mixture to mixture. While the L* value obtained by mixture F also is about 66, mixture G leads to a chromium deposit with a L* value of 61, which is as well very dark.

The chromium layers obtained with the inventive electroplating bath containing a mixture of coloring agents according to Formula (I) and Formula (II) are as well glossy.

Example 5

Distribution of the Dark Color on the Surface of Plated Workpieces

One coloring agent according to Formula (I) or Formula (II) or mixtures of coloring agents according to Formulae (I)

and (II) (Table 5) were added to the base electroplating bath (chloride based) as described in Example 1. The base electroplating bath of this Example containing mixtures of coloring agents contained 1.1 g/L Fe $SO_4$. $7H_2O$. The resulting baths were used to deposit a bright dark chromium layer on nickel plated copper panels in the same way as described in Example 1.

Color measurement was done at an area at the edge of the panels which is next to the anode and was done at an area in the center of the panels. The measuring area at the edge of the panel lies 2 cm to 3 cm from the lower edge and 0.5 cm to 1.5 cm from the edge of the panel which is next to the anode. The measuring area in the center of the panel lies 2 cm to 3 cm from the lower edge and 3 cm to 4 cm from the edge of the panel which is next to the anode. The edge of the panels which is next to the anode corresponds to the high current density (HCD) area of the panel. The center of the panels corresponds to the medium current density (MCD) area of the panel. The L*, a* and b* values measured for the obtained bright dark chromium deposits at HCD and MCD areas are shown in Table 5.

TABLE 5

Color of dark chromium layers at HCD and MCD area of the panels obtained for a single coloring agent or a mixture of coloring agents according to Formula (I) and/or Formula (II) present in the inventive electroplating bath.

| Mixture | Formula | Coloring Agent | Concentration g/L | HCD, Color L* a* b* | MCD, Collor L* a* b* |
|---|---|---|---|---|---|
| — | (I) | (1) 2-(2-Hydroxy-ethylsulfanyl)-ethanol | 23.6 | 76.6<br>0.0<br>0.7 | 76.5<br>0.0<br>0.8 |
| — | (I) | (12) Thiomorpholine | 3.0 | 73.9<br>0.0<br>0.7 | 73.7<br>0.1<br>1.1 |
| — | (I) | (15) Sodium thiocyanate | 1.5 | 65.8<br>0.6<br>4.2 | 65.5<br>0.6<br>4.3 |
| — | (II) | (16) 2-Amino-4-methane-sulfinyl-butyric acid | 2.0 | 74.5<br>0.0<br>0.7 | 74.6<br>0.0<br>0.8 |
| — | (II) | (18) Sodium prop-2-yne-1-sulfonate | 0.5 | 73.5<br>0.2<br>2.2 | 73.8<br>0.5<br>3.1 |
| A | (I) | (13) 2-[2-(2-Hydroxy-ethylsulfanyl)-ethylsulfanyl]-ethanol | 1.2 | 67.9<br>0.0<br>1.0 | 67.9<br>0.0<br>0.7 |
| | (I) | (8) 2-Amino-4-methylsulfanyl-butyric acid | 2.5 | | |
| E | (I) | (8) 2-Amino-4-methylsulfanyl-butyric acid | 2.5 | 66.1<br>0.2 | 66.0<br>0.1 |
| | (II) | (17) sodium salt of 1,1-Dioxo-1,2-dihydro-1lambda*6*-benzo[d]isothiazol-3-one•2 $H_2O$ | 1.5 | 1.5 | 1.4 |
| F | (I) | (1) 2-(2-Hydroxy-ethylsulfanyl)-ethanol | 11.8 | 66.3<br>0.3 | 66.8<br>0.2 |
| | (I) | (8) 2-Amino-4-methylsulfanyl-butyric acid | 2.5 | 2.9 | 2.1 |
| | (II) | (17) sodium salt of 1,1-Dioxo-1,2-dihydro-1lambda*6*-benzo[d]isothiazol-3-one•2 $H_2O$ | 1.0 | | |

The L* values of chromium layers determined at HCD and MCD area of the panels only show a slight variation. Thus, the inventive electroplating bath and inventive electroplating method yields a uniform distribution of the dark color over a broad range of current density. The inventive electroplating bath and inventive electroplating method are therefore very well suited to generate uniform dark colored chromium deposits onto flat plated workpieces as well as on workpieces with a complex structured surface.

Example 6

Deposition of Dark Chromium Layers by Chloride Based Electroplating Baths Containing Different Concentrations of Ferrous Ions One coloring agent according to Formula (II) was added to the base electroplating bath (chloride based) as described in Example 1. The base electroplating bath of this Example differed from Example 1 in containing different concentrations of ferrous ions. The resulting baths were used to deposit a bright dark chromium layer on nickel plated copper panels in the same way as described in Example 1.

Ferrous ions were added to the base electroplating bath in the form of Fe $SO_4.7H_2O$. The concentrations of the ferrous ions were in the range as outlined in Table 6.

The pH value was adjusted to 2.7 with 32% hydrochloric acid or 33% ammonia.

Coloring agent (17) 1,1-Dioxo-1,2-dihydro-1lambda*6*-benzo[d]isothiazol-3-one of the present invention was added to the base electroplating bath at a concentration of 2.1 g/L.

As a control experiment a chromium layer was deposited onto the nickel plated copper panel using the same conditions as described above but in absence of the coloring agent.

The thickness of each resulting chromium layer and its content of co-deposited iron were measured by X-ray fluorescence spectrometry (XRF spectrometry) on a Fischerscope X-ray XDAL spectrometer. XRF spectrometry is based on the phenomenon that material which has been excited by bombarding with high-energy X-rays or gamma rays emits characteristic "secondary" (or fluorescent) X-rays. This X-ray fluorescence can be used for analysis of the material. In this case the resulting chromium layers were analysed. Measuring spots were in the MCD area of the panels as described in Example 1 for the areas of color measurement. Each measuring spot was examined two times and an average value was calculated. The collimator was adjusted to biggest size, measuring times were set to 30 seconds and the X-ray radiation had an energy of 50 kV. Generated X-ray fluorescence was analysed by the fundamental parameter method. The resulting data of thickness and iron content of the chromium layers are summarized in Table 6.

TABLE 6

Thickness of dark chromium layers and iron content.

| Concentration of $Fe^{2+}$/mg/L | coloring agent (17) | thickness of chromium layer/μm | content of iron in chromium layer/% |
|---|---|---|---|
| 200 | --- | 0.88, 0.87 | 7.8, 7.5 |
| 280 | + | 0.27, 0.27 | 30.5, 31.3 |
| 200 | + | 0.21, 0.21 | 27.4, 27.5 |
| 80 | + | 0.11, 0.11 | 18.3, 21.1 |
| 0 | + | 0.06, 0.06 | 0.14, 0.21 |

"---" means no coloring agent present;
"+" means coloring agent present

If the electrolyte did not contain ferrous ions the achieved chromium layer was only 0.06 μm thick (Table 6). If the electrolyte contained 200 mg/L ferrous ions but no coloring agent the chromium layer achieved a much higher thickness of 0.88 μm. Interestingly, if the electrolyte contained the same amount of ferrous ions plus coloring agent (17) the achieved chromium layer had also a higher thickness (0.21 μm) than without ferrous ions. Thus, the coloring agent seems to reduce the deposition rate of chromium. In contrast, the ferrous ions enhance the deposition rate and this effect is still active in the presence of a coloring agent thus, beneficially counteracting and overruling the effect of the coloring agent on the deposition rate.

In this Example also the content of iron codeposited into the chromium layers was measured. Chromium layers deposited from the electrolyte containing 200 mg/L ferrous ions but no coloring agent showed an iron content between 7.5 and 7.8%. The same electrolyte containing a coloring agent in addition to ferrous ions resulted in a chromium deposit containing more than 3 times as much iron (27.5%). This is an unexpected high increase in codeposition of iron in a chromium deposit when a coloring agent of the present invention is present in the electrolyte.

Example 7

Deposition of Dark Chromium Layers by Chloride Based Electroplating Baths Containing Different Concentrations of Ferrous Ions One coloring agent according to Formula (I) or mixtures of coloring agents according to Formulae (I) and (II) (Table 5) were added to the base electroplating bath (chloride based) as described in Example 1. The base electroplating bath of this Example differed from Example 1 in containing different concentrations of ferrous ions. The resulting baths were used to deposit a bright dark chromium layer on nickel plated copper panels in the same way as described in Example 1.

Ferrous ions were added to the base electroplating bath in the form of Fe $SO_4.7H_2O$. The concentrations of the ferrous ions were in the range as outlined in Table 7.

The pH value was adjusted to 2.8 with 32% hydrochloric acid or 33% ammonia.

A single coloring agent or a mixture of coloring agents of the present invention were added to the base electroplating bath at a concentration as outlined in Table 7.

As a comparative example a chromium layer was deposited onto the nickel plated copper panel using the same conditions as described above but in absence of a coloring agent and in absence of ferrous ions.

The color of the chromium layers obtained on the nickel plated copper panels were measured at the MCD areas as described in Example 1. The resulting L*, a* and b* values are shown in Table 7.

TABLE 7

Color of the dark chromium layer obtained for chromium layers deposited from the inventive electroplating bath containing different concentrations of ferrous ions.

| Mixture | Formula | Coloring Agent | Concentration g/L | Concentration of $Fe^{2+}$ mg/L | MCD, Collor L* a* b* |
|---|---|---|---|---|---|
| — | (I) | (8) 2-Amino-4-methylsulfanyl-butyric acid | 4.1 | 0 | 72.84<br>0.07<br>0.50 |
| | | | | 40 | 72.67<br>0.20<br>0.24 |

TABLE 7-continued

Color of the dark chromium layer obtained for chromium layers deposited from the inventive electroplating bath containing different concentrations of ferrous ions.

| Mixture | Formula | Coloring Agent | Concentration g/L | Concentration of $Fe^{2+}$ mg/L | MCD, Collor L* a* b* |
|---|---|---|---|---|---|
| | | | | 120 | 70.51<br>0.02<br>0.22 |
| | | | | 200 | 69.00<br>−0.05<br>0.00 |
| — | (I) | (13) 2-[2-(2-Hydroxy-ethylsulfanyl)-ethylsulfanyl]-ethanol | 1.2 | 0 | 73.38<br>0.08<br>0.88 |
| | | | | 40 | 71.98<br>0.06<br>0.81 |
| | | | | 120 | 71.22<br>0.05<br>0.70 |
| | | | | 200 | 70.61<br>0.02<br>0.53 |
| — | (I) | (1) 2-(2-Hydroxy-ethylsulfanyl)-ethanol | 23.7 | 0 | 73.23<br>0.05<br>1.20 |
| | | | | 40 | 72.99<br>0.03<br>1.03 |
| | | | | 120 | 71.94<br>0.00<br>0.64 |
| | | | | 200 | 70.67<br>−0.01<br>0.74 |
| J | (I) | (8) 2-Amino-4-methylsulfanyl-butyric acid | 2.7 | 0 | 69.41<br>0.12<br>1.16 |
| | (I) | (13) 2-[2-(2-Hydroxy-ethylsulfanyl)-ethylsulfanyl]-ethanol | 1.2 | 40 | 68.82<br>0.04<br>0.78 |
| | | | | 120 | 67.73<br>0.01<br>0.51 |
| | | | | 200 | 66.94<br>0.02<br>0.57 |
| K | (I) | (8) 2-Amino-4-methylsulfanyl-butyric acid | 3.0 | 0 | 67.39<br>0.48<br>3.37 |
| | (II) | (17) 1,1-Dioxo-1,2-dihydro-1lambda*6*-benzo[d]isothiazol-3-one | 2.1 | 40 | 65.99<br>0.41<br>3.29 |
| | (I) | (15) Sodium thiocyanate | 1 g/L | 120 | 65.04<br>0.49<br>3.55 |
| | | | | 200 | 63.58<br>0.52<br>3.9 |
| — | — | Comparative Example | none | none | 82.61<br>0.08<br>0.65 |

A chromium layer deposited from an electrolyte free of coloring agent and free of ferrous ions yields a L+ value of 82.6 (comparative example). The L* values of the deposits from the electrolyte containing solely one or more coloring agents (no ferrous ions) were usually about 10 units or even more lower than the L* value of the control experiment. Thus, the chromium deposits resulting from electrolytes containing solely coloring agents but no ferrous ions are already much darker than the control experiment. The L* values of deposits from the electrolyte containing ferrous ions in addition to coloring agents show that the chromium deposits become darker with increasing concentration of ferrous ions.

Example 8

Deposition of Dark Chromium Layers by Sulphate Based Electroplating Baths Containing Mixtures of Coloring Agents Copper panels (99 mm×70 mm) were used as workpieces.

Cleaning:

The copper panels were firstly cleaned by electrolytic degreasing with Uniclean® 279 (product of Atotech Deutschland GmbH), 100 g/L at room temperature (RT). Afterwards the copper panels were pickled with 10% $H_2SO_4$ by volume and rinsed with water.

Nickel Plating:

The cleaned copper panels were plated with a bright nickel layer for 10 min at 4 A/dm$^2$ with a Makrolux® NF electrolyte (product of Atotech Deutschland GmbH).

Deposition of Bright Dark Chromium Layer:

A base electroplating bath was prepared consisting of the following ingredients:

56 g/L Boric acid
67.2 g/L Sodium sulphate
156.8 g/L Potassium sulphate
10 g/L Malic acid
0.13 g/L Sodium vinyl sulfonate
54 g/L Basic chromium sulphate The pH value was adjusted to 3.5 with 25% sulfuric acid or 25% solution of sodium hydroxide.

A coloring agent of the present invention was added to the base electroplating bath at a concentration as outlined in Table 8.

The electroplating bath containing a coloring agent was introduced into a Hull cell having a platinized titanium anode and a nickel plated copper panel was installed as the cathode. A plating current of 2 A was passed through the solution for 5 minutes at 55° C. Dark chromium was deposited from about 4 A/dm$^2$ to the top of the nickel plated copper panel. Afterwards the chromium plated panels were rinsed with water.

The color of the chromium layers obtained on the nickel plated copper panels were measured by a colorimeter (Dr. Lange LUCI 100). Calibration was done with black and white standard. Color measurement was done at an area in the center of the panels. The measuring area lies on the panel 2 cm to 3 cm from the lower edge and 3 cm to 4 cm from the edge of the panel which is next to the anode. The center of the panels corresponds to the medium current density (MCD) area of the panels. The resulting L*, a* and b* values are shown in Table 8.

TABLE 8

Color of the dark chromium layer obtained for mixtures of coloring agents present in the inventive electroplating bath.

| Mixture | Formula | Coloring Agent | Concentration g/L | MCD, Color L* a* b* |
|---|---|---|---|---|
| L | (II) | (17) sodium salt of 1,1-Dioxo-1,2-dihydro-1lambda*6*-benzo[d]isothiazol-3-one•2 $H_2O$ | 2.9 | 67.3<br>−0.4<br>−0.3 |

TABLE 8-continued

Color of the dark chromium layer obtained for mixtures of coloring agents present in the inventive electroplating bath.

| Mixture | Formula | Coloring Agent | Concentration g/L | MCD, Color L* a* b* |
|---|---|---|---|---|
| | (I) | (8) 2-Amino-4-methylsulfanyl-butyric acid | 11.0 | |
| M | (II) | (17) sodium salt of 1,1-Dioxo-1,2-dihydro-1lambda*6*-benzo[d]isothiazol-3-one•2 $H_2O$ | 4.3 | 67.9<br>0.6<br>4.1 |
| | (I) | (15) Potassium thiocyanate | 5.9 | |
| | (I) | (1) 2-(2-Hydroxy-ethylsulfanyl)-ethanol | 11.0 | |
| N | (II) | (17) sodium salt of 1,1-Dioxo-1,2-dihydro-1lambda*6*-benzo[d]isothiazol-3-one•2 $H_2O$ | 3.94 | 65.7<br>0.4<br>2.8 |
| | (I) | (8) 2-Amino-4-methylsulfanyl-butyric acid | 5.5 | |
| | (I) | (15) Potassium thiocyanate | 4.4 | |
| | (I) | (1) 2-(2-Hydroxy-ethylsulfanyl)-ethanol | 8.25 | |

The L* values of chromium layers obtained with sulphate based electroplating baths containing a mixture of coloring agents according to Formula (I) and Formula (II) are well below 70. Thus, the chromium layers obtained with the inventive electroplating bath containing mixtures of coloring agents according to Formula (I) and Formula (II) are always darker than chromium layers resulting from conventional hexavalent or trivalent chromium baths or from chromium baths containing iron II ions as described at page 15.

The invention claimed is:

1. An electroplating bath for deposition of a dark chromium layer on a workpiece, the electroplating bath comprising:

(A) trivalent chromium ions;
(B) carboxylate ions;
(C) at least one pH buffer substance; and
(D) at least one coloring agent comprising 2-[2-(2-Hydroxy-ethylsulfanyl)-ethylsulfanyl]-ethanol, and, optionally, further comprising one or both of:
at least one coloring agent selected from sulphur containing compounds having the general Formula (I)

Formula (I)

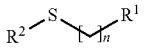

wherein n, p, q are independently of each other integers from 0 to 4;

$R^1$ represents —H, —OH, —COOH, —CO—$OCH_3$, —CO—$OCH_2$—$CH_3$, —(—O—$CH_2$—$CH_2$—)$_m$—OH, —CH(—$NH_2$)—COOH, —CH(—NH—$CH_3$)—COOH, —CH(—N(—$CH_3$)$_2$)—COOH, —CH(—$NH_2$)—CO—$OCH_3$, —CH(—$NH_2$)—CO—$OCH_2$—$CH_3$, —CH(—$NH_2$)—$CH_2$—OH, —CH(—NH—$CH_3$)—$CH_2$—OH, —CH(—N(—$CH_3$)$_2$)—$CH_2$—OH, —$SO_3H$;

m represents an integer from 5 to 15;

$R^2$ represents —H, —OH, —$(CH_2—)_p$—OH, —$(CH_2—)_p$—C(—$NH_2$)═NH, —$CH_2$—$CH_2$—(—O—$CH_2$—$CH_2$—)$_m$—OH, —$R^5$, —$(CH_2—)_q$—COOH, —$(CH_2—)_q$—CO—$OCH_3$, —$(CH_2—)_q$—CO—$OCH_2$—$CH_3$, —$(CH_2—)_q$—S—$(CH_2—)_2$—OH, —CS—$CH_3$, —CS—$CH_2$—$CH_3$, —CS—$CH_2$—$CH_2$—$CH_3$, —CN,

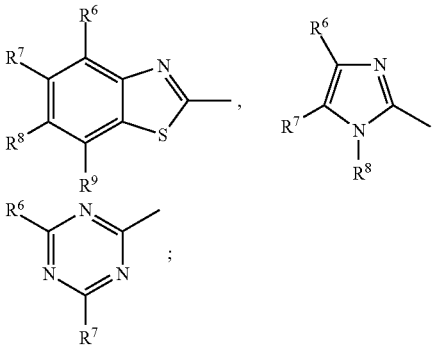

$R^1$ and $R^2$ together represent a linear chain structure in order to build one of the following ring structures including the central sulphur atom of Formula (I)

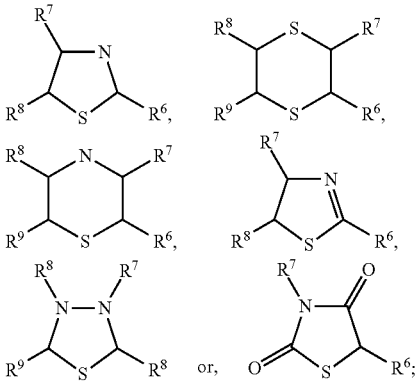

$R^5$ represents —H, —$CH_3$, —$CH_2$—$CH_3$, —$CH_2$—$CH_2$—$CH_3$, or $CH_2$—$CH_2$—$CH_2$—$CH_3$;

$R^6$, $R^7$, $R^8$, $R^9$ represent independently of each other —H, —$NH_2$, —SH, —OH, —$CH_3$, —$CH_2$—$CH_3$, —COOH, or —$SO_3H$;

and at least one coloring agent selected from sulphur containing compounds having the general Formula (II)

Formula (II)

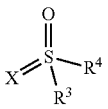

wherein

═X represents ═O, or a free electron pair;

$R^3$ represents —$R^5$, —CH═$CH_2$, —$CH_2$—CH═$CH_2$, —CH═CH—$CH_3$, $CH_2$—$CH_2$—CH═$CH_2$, —$CH_2$—CH═CH—$CH_3$, —CH═CH—$CH_2$—$CH_3$, —C≡CH, —$CH_2$—C≡CH, —C≡C—$CH_3$, —$CH_2$—$CH_2$—C≡CH, —$CH_2$—C≡C—$CH_3$, —C≡C—$CH_2$—$CH_3$, —C(—$NH_2$)═NH,

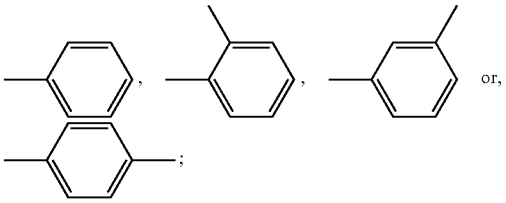

$R^4$ represents —$R^5$, —$OR^5$, —$(CH_2—)_r$—CH(—$NH_2$)—COOH, —$(CH_2—)_r$—CH(—NH—$CH_3$)—COOH, —$(CH_2—)_r$—CH(—N(—$CH_3)_2$)—COOH, —$(CH_2—)_r$—CH(—$NH_2$)—CO—$OCH_3$, or —$(CH_2—)_r$—CH(—$NH_2$)—CO—$OCH_2$—$CH_3$;

r is an integer from 0 to 4;

$R^3$ and $R^4$ together represent a linear chain structure in order to build one of the following ring structures including the central sulphur atom of Formula (II)

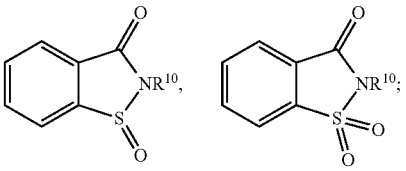

$R^{10}$ represents —H, —$CH_3$, —$CH_2$—$CH_3$, —$CH_2$—$CH_2$—$SO_3H$;

or salts, tautomeric forms, betaine structures thereof; and (E) ferrous ions.

2. The electroplating bath according to claim 1, wherein the bath includes the at least one coloring agent selected from sulphur containing compounds having the general Formula (I), and the sulphur containing compounds having the general Formula (I) are selected from compounds wherein $R^1$ is not H if $R^2$ is H or $R^2$ is not H if $R^1$ is H.

3. The electroplating bath according to claim 1, wherein the bath includes the at least one coloring agent selected from sulphur containing compounds having the general Formula (I), and the sulphur containing compounds having the general Formula (I) are selected from compounds wherein $R^1$ is —OH, and $R^2$ is selected from the group consisting of —$(CH_2—)_p$—OH and —$(CH_2—)_q$—S—$(CH_2—)_2$—OH, wherein q is 0, 1, 3, or 4.

4. The electroplating bath according to claim 1, wherein the bath includes the at least one coloring agent selected from sulphur containing compounds having the general Formula (II), and the sulphur containing compounds having the general Formula (II) are selected from compounds wherein $R^3$ and $R^4$ together represent the linear chain structure in order to build one of the following ring structures including the central sulphur atom of Formula (II)

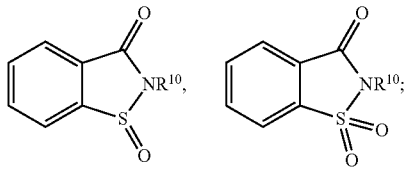

in which $R^{10}$ represents —H, —$CH_3$, —$CH_2$—$CH_3$ or —$CH_2$—$CH_2$—$SO_3H$.

5. The electroplating bath according to claim 1, wherein the bath includes the at least one coloring agent selected from sulphur containing compounds having the general Formula (I), and the coloring agent according to Formula (I) is a sulphur containing compound selected from:

(1) 2-(2-Hydroxy-ethylsulfanyl)-ethanol,
(2) Thiazolidine-2-carboxylic acid,
(3) Thiodiglycol ethoxylate,
(4) 2-Amino-3-ethylsulfanyl-propionic acid,
(5) 3-(3-Hydroxy-propylsulfanyl)-propan-1-ol,
(6) 2-Amino-3-carboxymethylsulfanyl-propionic acid,
(7) 2-Amino-4-methylsulfanyl-butan-1-ol,
(8) 2-Amino-4-methylsulfanyl-butyric acid,
(9) 2-Amino-4-ethylsulfanyl-butyric acid,
(10) 3-Carbamimidoylsulfanyl-propane-1-sulfonic acid,
(11) 3-Carbamimidoylsulfanyl-propionic acid,
(12) Thiomorpholine,
(14) 4,5-Dihydro-thiazol-2-ylamine,
(15) Thiocyanic acid.

6. The electroplating bath according to claim 1, further comprising chloride ions or bromide ions.

7. The electroplating bath according to claim 1, wherein the bath includes the at least one coloring agent selected from sulphur containing compounds having the general Formula (I), and the concentration of the coloring agent according to general Formula (I) ranges from 0.01 g/L to 100 g/L.

8. The electroplating bath according to claim 1, wherein the bath includes the at least one coloring agent selected from sulphur containing compounds having the general Formula (II), and the concentration of the coloring agent according to general Formula (II) ranges from 0.01 g/L to 100 g/L.

9. The electroplating bath according to claim 1, wherein the concentration of the ferrous ions ranges from 40 mg/L to 280 mg/L.

10. The electroplating bath according to claim 1, wherein the bath is free of compounds containing phosphorus.

11. The electroplating bath according to claim 1, wherein the bath includes both the at least one coloring agent selected from sulphur containing compounds having the general Formula (I) and the at least one coloring agent selected from sulphur containing compounds having the general Formula (II).

12. The electroplating bath according to claim 11, wherein the sulphur containing compounds having the general Formula (I) are selected from compounds wherein $R^1$ is not H if $R^2$ is H or $R^2$ is not H if $R^1$ is H.

13. The electroplating bath according to claim 11, wherein the sulphur containing compounds having the general Formula (I) are selected from compounds wherein $R^1$ is —OH, and $R^2$ is selected from the group consisting of —$(CH_2—)_q$—OH and $(CH_2—)_q$—S—$(CH_2—)_2$—OH, wherein q is 0, 1, 3, or 4.

14. The electroplating bath according to claim 11, wherein the sulphur containing compounds having the general Formula (II) are selected from compounds wherein $R^3$ and $R^4$ together represent the linear chain structure in order to build one of the following ring structures including the central sulphur atom of Formula (II)

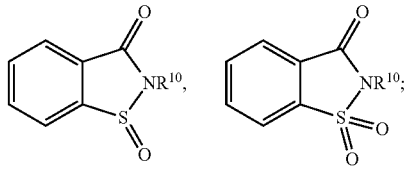

in which $R^{10}$ represents —H, —$CH_3$, —$CH_2$—$CH_3$ or —$CH_2$—$CH_2$—$SO_3H$.

15. The electroplating bath according to claim 11, wherein the coloring agent according to Formula (I) is a sulphur containing compound selected from:

(1) 2-(2-Hydroxy-ethylsulfanyl)-ethanol,
(2) Thiazolidine-2-carboxylic acid,
(3) Thiodiglycol ethoxylate,
(4) 2-Amino-3-ethylsulfanyl-propionic acid,
(5) 3-(3-Hydroxy-propylsulfanyl)-propan-1-ol,
(6) 2-Amino-3-carboxymethylsulfanyl-propionic acid,
(7) 2-Amino-4-methylsulfanyl-butan-1-ol,
(8) 2-Amino-4-methylsulfanyl-butyric acid,
(9) 2-Amino-4-ethylsulfanyl-butyric acid,
(10) 3-Carbamimidoylsulfanyl-propane-1-sulfonic acid,
(11) 3-Carbamimidoylsulfanyl-propionic acid,
(12) Thiomorpholine,
(14) 4,5-Dihydro-thiazol-2-ylamine,
(15) Thiocyanic acid.

16. A method for electrodepositing a dark chromium layer on a workpiece which comprises electroplating said workpiece with the electroplating bath as defined in claim 1.

* * * * *